US005556180A

United States Patent [19]

Miller et al.

[11] Patent Number: 5,556,180

[45] Date of Patent: Sep. 17, 1996

[54] FILING CABINET DRAWER

[75] Inventors: Regis R. Miller, Dover; George E. Mellor, Smyrna; Theodore W. Norman, Sr.; Mary V. Jamieson, both of Dover; Michael J. Thompson, Smyrna; Willis Sherrod, Sr., Camden; Dana H. Clarke, Hartly; Jerome D. Webb, Wyoming; Robert D. Wisniewski, Felton, all of Del.

[73] Assignee: General Metalcraft, Inc., Dover, Del.

[21] Appl. No.: 309,445

[22] Filed: Sep. 20, 1994

[51] Int. Cl.[6] ..... A47B 63/00

[52] U.S. Cl. ..... 312/193; 312/185

[58] Field of Search ..... 312/187, 193, 312/183, 348.3, 351; 211/184

[56] References Cited

U.S. PATENT DOCUMENTS 4,595,098 6/1986 Kryter ..... 312/9.54

5,205,625 4/1993 Koch ..... 312/193

5,211,458 5/1993 Yale .

5,214,836 6/1993 Beals ..... 312/185

*Primary Examiner*—Peter M. Cuomo

*Assistant Examiner*—Gerald Anderson

*Attorney, Agent, or Firm*—Antonelli, Terry, Stout & Kraus

[57] ABSTRACT

A filing cabinet drawer which includes a plurality of spaced retainers provided along a bottom wall of the drawer for retaining lower ends of the articles contained in the filing cabinet drawer. A support member is provided for supporting the articles in the filing cabinet drawer in such a manner that the articles are held in a substantially upright position. Ledges are provided on spaced side walls of the cabinet drawer with the ledges being provided with spaced openings so as to enable an adjustment of the support member in dependence upon the number of articles inserted into the cabinet drawer.

10 Claims, 2 Drawing Sheets

FILING CABINET DRAWER

FIELD OF THE INVENTION

The present invention relates to a filing cabinet construction and, more particularly, a filing cabinet drawer constructed so as to enable items disposed or stored therein to remain in the substantially upright position.

Examples of arrangements for maintaining items in a substantially upright position are proposed in, for example, U.S. Pat. Nos. 1,405,993, 1,725,702, 4,512,480, 4,592,471 and 5,211,458.

A disadvantage of the proposed constructions resides in the fact that they are difficult to assemble and are expensive to manufacture.

SUMMARY OF THE INVENTION

The aim underlying the present invention resides in providing a filing cabinet drawer constructed so enable items stored therein to remain in a substantially upright position which avoids the disadvantages encountered in the prior art.

In accordance with advantageous features of the present invention, a filing cabinet drawer is provided which includes a one piece drawer body comprising two spaced side walls connecting a rear wall, and a bottom wall, with each of the side walls including a ledge portion having a plurality of openings therein spaced in a longitudinal direction of the respective ledge portions. The support member is provided for supporting the articles in the filing cabinet drawer, with a plurality of spaced retainers being provided along the bottom wall for retaining articles contained in the filing cabinet drawer. A support member is provided for supporting the articles in the filing cabinet drawer in such a manner that the articles are held in a substantially upright position.

Advantageously, in accordance with the present invention, the support member includes a pair of spaced leg portions respectively terminating in bent leg portions. The spaced leg portions are respectively accommodated in a first pair of openings in the respective ledge portions and the bent edge portions are accommodated in a second pair of the openings spaced from the first pair of the openings so as to enable the support member to be adjusted in dependence upon the number of articles placed in the filing cabinet drawer.

In order to provide adequate support for the articles, the support member includes a central portion having a substantially V-shaped configuration.

Advantageously, the retainers are fashioned as projections extending upwardly from the bottom wall of the filing cabinet drawer. The projections may be of a semi-circular configuration and the support member may be fashioned as a bent wire.

By virtue of the above noted features of the present invention, it is possible to provide a filing cabinet drawer construction which ensures an orderly substantially upright arrangement of articles disposed therein while, at the same time, enabling an easy adjustability so as to permit the file drawer cabinet to accommodate any number of items.

DETAILED DESCRIPTION

Figure 1:
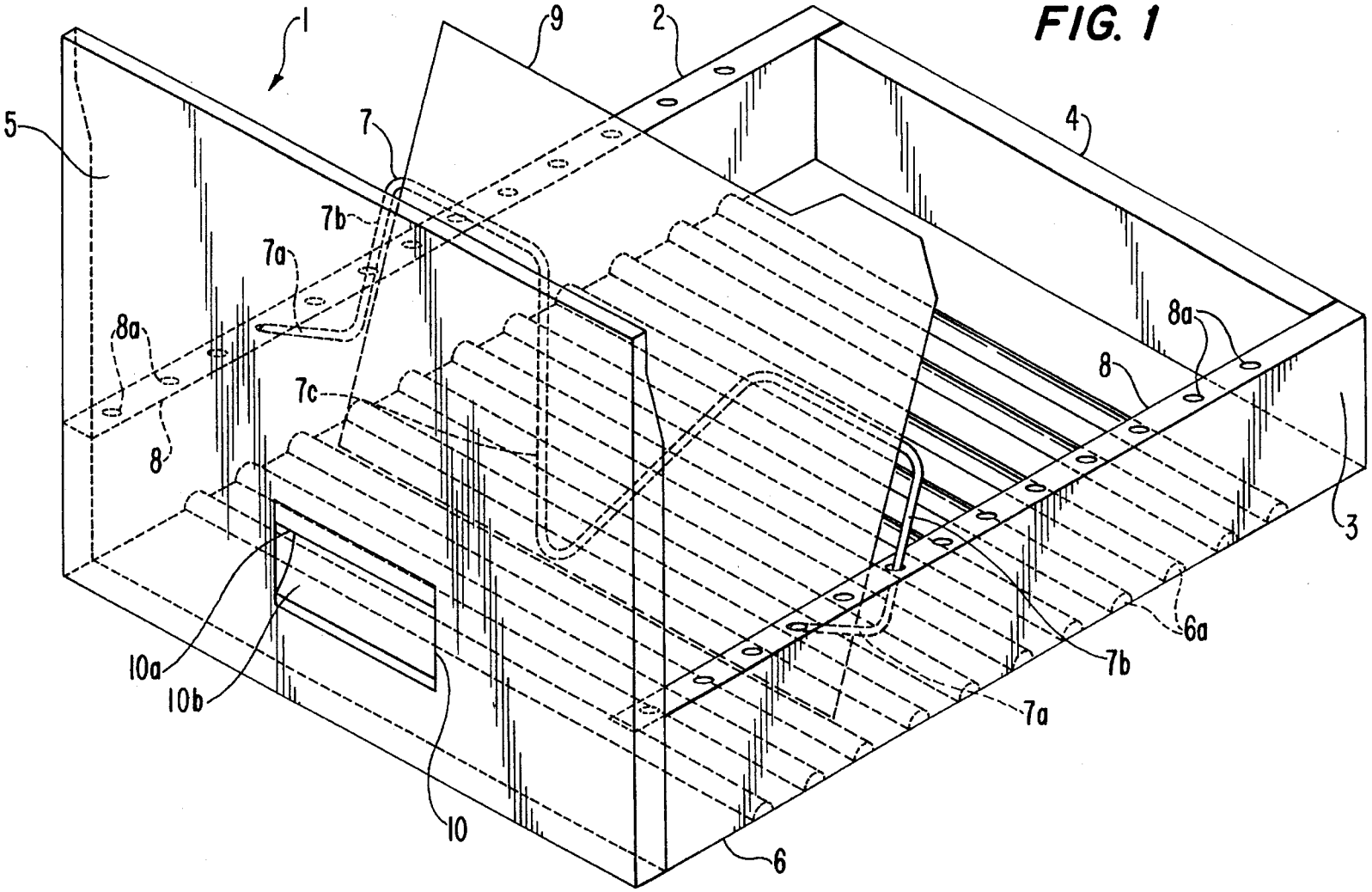
FIG. 1 a perspective view of a filing cabinet drawer constructed in accordance with the present invention.

Referring now to the drawings wherein like reference numerals are used throughout the various views to designate like parts and, more particularly, to FIG. 1, according to this figure, a drawer generally designated by the reference numeral 1 for a filing cabinet (not shown) includes a pair of spaced side walls 2, 3, and rear wall 4 and a front wall 5 provided with a one-piece handle defined by recessed area 10, a groove portion 10*a* and an area 10*b* Each of the side walls 2, 3 includes a ledge 8 extending toward an interior of the cabinet drawer 1. Each of the ledges 8 are provided with a plurality of spaced holes or openings 8*a*. The bottom wall 6 of the cabinet drawer 1 is provided with a plurality of spaced vertically extending projections or protrusions 6*a* forming retainers, which, in the illustrated embodiment, are semi-circular; however, as can be appreciated, other configuration are possible. The projections or protrusions 6*a* function as retainers for preventing the lower ends of the articles 9 from slipping or sliding in a forward direction of the cabinet drawer 1. The projection 6*a* may be integrally formed with a bottom wall 6 or be provided as a separate corrugated member mounted on the bottom wall 6.

Figure 2:
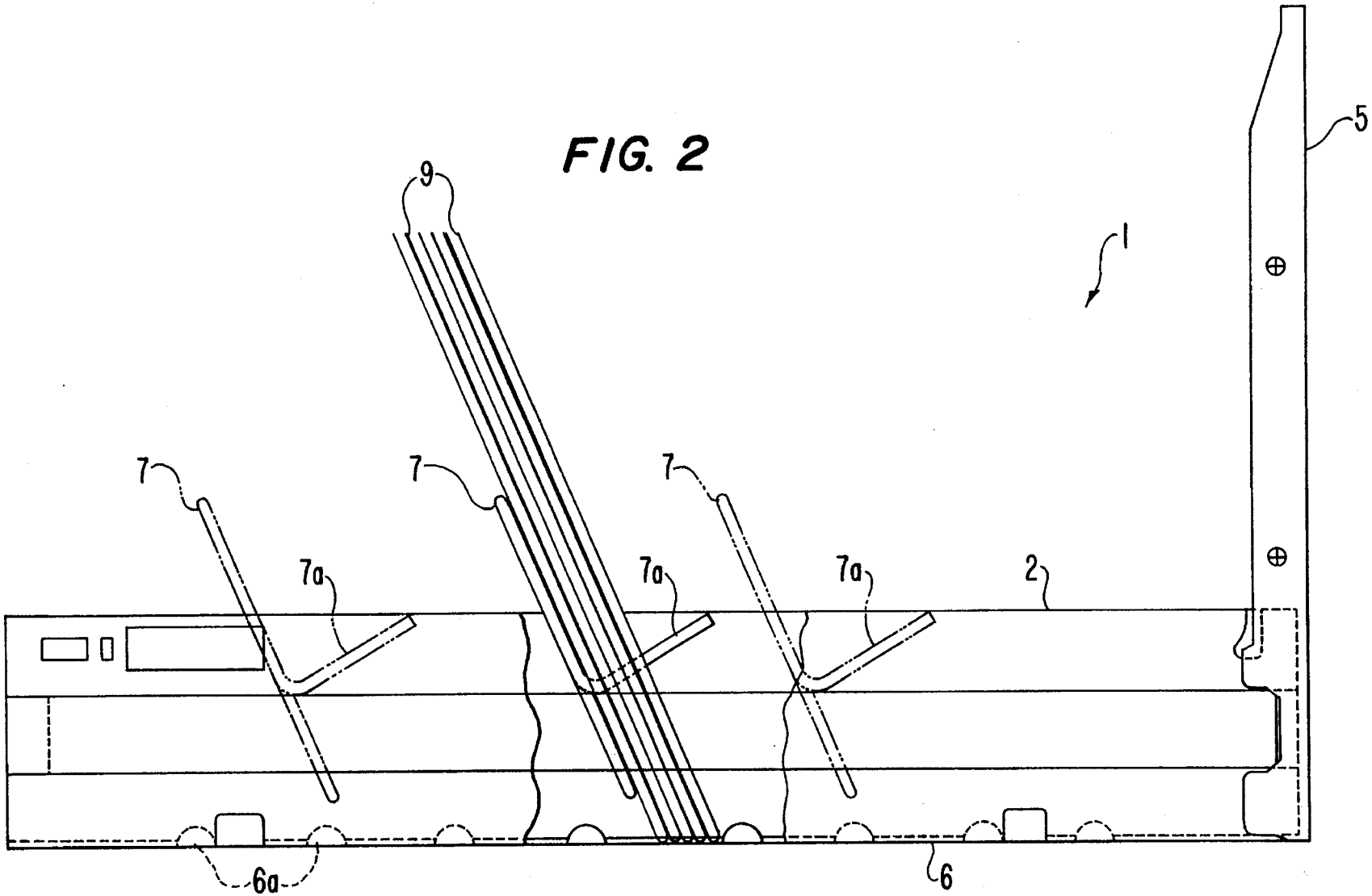
FIG. 2 is a side view of the drawer of FIG. 1.

To enable an orderly positioning of the articles 9 in the cabinet drawer 1, at least one support member 7 is provided for maintaining the articles in a substantially upright position. The support member 7 is preferably formed as a wire member terminating in bent end portions 7*a* adapted to be received in the holes or openings 8*a* provided in the ledges 8. The provision of the holes or openings 8*a* enable an adjustability of the support member 7 in dependence upon the number of articles stored in the filing cabinet drawer 1. Furthermore, as illustrated in FIG. 2, if necessary, several support members 7 may be provided.

As shown in FIG. 1, leg portions 7*b* of the support member 7 are respectively insertable into the holes or openings 8*a* of the ledges 8, with end portions of the bent portions 7*a* being respectively accommodated in the holes or openings 8*a* so as to fix the support member 7 in place. To ensure a stable support of the articles 9 in the file cabinet drawer 1, a central portion of the support member 7 has a substantially V-shaped portion 7*c*.

In use, the articles 9 are inserted into the filing cabinet drawer 1 and depending upon the number of inserted articles 9, the support member is inserted into appropriate holes 8*a* and secured in position by the ends of the bent arm portions 7*a* in the holes 8*a*.

As readily apparent, the support member 7 need not be fashioned of a wire material but may, for example, be fashioned of a suitable plastic material.

While we have shown and described only one embodiment in accordance with the present invention, it is understood that the same is not limited thereto but is susceptible to numerous changes and modifications as known to one of ordinary skill in the art, and we therefore do not wish to be limited to the details shown and described herein, but intend to cover all such modifications as are encompassed by the scope of the appended claims.

We claim:

1. A filing cabinet drawer comprising a rear wall, a front wall, two spaced side walls connecting said front wall and said rear wall, and a bottom wall, each of said side walls including a ledge portion having a plurality of openings therein spaced in a longitudinal direction of the respective ledge portions, at least one support member for supporting articles in the filing cabinet drawer, and a plurality of spaced retainers provided along the bottom wall for retaining lower edges of the articles contained in the filing cabinet drawer in a specific position, the at least one support member for supporting the articles in the filing cabinet drawer in such a manner that the articles are held in a substantially upright position, wherein the at least one support member includes a pair of spaced leg portions respectively terminating in bent end leg portions, and wherein said spaced leg portions are respectively accommodated in a first pair of said openings in the respective ledge portions and the bent end portions are accommodated in a second pair of said openings spaced from said first pair of openings so as to enable the support member to be adjusted in dependence upon the number of articles placed in the filing cabinet drawer.

2. A filing cabinet drawer according to claim 1, wherein the spaced retainers are fashioned as projections extending upwardly from the bottom wall of the filing drawer cabinet.

3. A filing cabinet drawer according to claim 2, wherein the at least one support member includes a central portion having a substantially V-shaped configuration.

4. A filing cabinet drawer according to claim 3, wherein said projections are of a semi-circular configuration.

5. A filing cabinet drawer according to claim 4 wherein said support member is fashioned as a bent wire.

6. A filing cabinet drawer comprising a rear wall, a front wall, two spaced side walls connecting said front wall and said rear wall, and a bottom wall, each of said side walls including a ledge portion having a plurality of openings therein spaced in a longitudinal direction of the respective ledge portions, at least one support member for supporting articles in the filing cabinet drawer, the at least one support member including a wire member having terminal portions accommodated in the openings of the respective ledge portions and a central portion extending from the terminal portions between the two spaced side walls of the filing cabinet drawer, and a plurality of spaced retainers provided along the bottom wall for retaining lower edges of the articles contained in the filing cabinet drawer in a specific position, the wire member of the at least one support member and at least one of the plurality of spaced retainers cooperating with at least one of the articles for supporting the articles in the filing cabinet drawer in such a manner that the articles are held in a substantially upright position, wherein the terminal portions of the wire member are accommodated in first and second spaced openings in the respective ledge portions of the two spaced side walls.

7. A filing cabinet drawer according to claim 6, wherein the spaced retainers are fashioned as projections extending upwardly from the bottom wall of the filing drawer cabinet.

8. A filing cabinet drawer according to claim 6, wherein the filing cabinet drawer is accommodated in a filing cabinet and is arranged for movement with respect to the filing cabinet.

9. A filing cabinet drawer according to claim 1, wherein the terminal portions of the wire member each include a leg portion terminating in a bent end portion wherein the leg portion is accommodated in a first opening in the respective ledge portions of the two spaced side walls and the bent end portion is accommodated in a second opening spaced from the first opening in the respective ledge portions of the two spaced side walls.

10. A filing cabinet drawer according to claim 1, wherein the spaced retainers are projections extending upwardly from the bottom wall of the filing cabinet drawer and extending over substantially an entire width of the filing cabinet drawer between the two spaced side walls.

* * * * *